US008064076B2

(12) United States Patent
Motoyama

(10) Patent No.: US 8,064,076 B2
(45) Date of Patent: Nov. 22, 2011

(54) PRINTER, PRINTER CONTROL METHOD, AND PRINTER CONTROL PROGRAM

(75) Inventor: Hiroyuki Motoyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 381 days.

(21) Appl. No.: 11/998,309

(22) Filed: Nov. 29, 2007

(65) Prior Publication Data

US 2008/0123137 A1 May 29, 2008

(30) Foreign Application Priority Data

Nov. 29, 2006 (JP) ..... 2006-321899

(51) Int. Cl.
*G06F 3/12* (2006.01)
*G06K 15/00* (2006.01)

(52) U.S. Cl. ..... 358/1.14; 358/1.15; 358/1.13

(58) Field of Classification Search ..... 358/1.14, 358/1.15, 1.9, 1.13, 1.1; 347/14, 15, 16, 347/17; 399/111, 125; 400/639.1, 550, 551
See application file for complete search history.

(56) References Cited

U.S. PATENT DOCUMENTS 4,714,364 A * 12/1987 Takada ..... 400/639.1
5,436,731 A 7/1995 Miura

FOREIGN PATENT DOCUMENTS

| | | | |
|---|---|---|---|
| JP | 3-230666 | A | 10/1991 |
| JP | 05-221085 | | 8/1993 |
| JP | 10-010936 | A | 1/1998 |
| JP | 10-337933 | | 12/1998 |
| JP | 2000-188659 | A | 7/2000 |
| JP | 2000-322228 | | 11/2000 |
| JP | 2002036668 | A * | 2/2002 |
| JP | 2004-034408 | | 2/2004 |

* cited by examiner

*Primary Examiner* — Charlotte M Baker
(74) *Attorney, Agent, or Firm* — Nutter McClennen & Fish LLP; John J. Penny, V.

(57) ABSTRACT

The printer is connected to an interface device and communicates through the interface device with external devices, and has a detector that detects a prescribed operation of the printer, a controller that receives a query signal sent from the interface device, and confirms the reception status of the query signal after the detector detects the prescribed operation, wherein the controller determines the operating status of the interface device based on the query signal reception status confirmed by the controller.

23 Claims, 4 Drawing Sheets

PRINTER, PRINTER CONTROL METHOD, AND PRINTER CONTROL PROGRAM

Priority is claimed under 35 U.S.C. §119 to Japanese Application No. 2006-321899 filed on Nov. 29, 2006, which is hereby incorporated by reference in its entirety.

BACKGROUND OF THE INVENTION

1. Field of Invention

The present invention relates to a printer that communicates with an external device through an interface device, and relates more particularly to a printer that can effectively handle problems caused by static electricity in the interface device.

2. Description of Related Art

Printers are often used while connected over a network to the host device that sends print requests to the printer. In such situations, an interface device that controls the communication interface between the printer and the host device or other external device is disposed in the printer or separately from the printer, and the printer and external device communicate through the interface device.

Printers also use consumables such as ink, toner, or other color material and a print medium such as paper, and these consumables are replaced as needed by the user. Replacing the consumables typically involves opening a printer cover and performing some operation inside the printer, at which time the user may touch metal parts inside the printer. This poses the danger of static electricity from the user's body being discharged to the metal part, which can cause such problems as rendering the interface device nonfunctional.

To prevent this, parts that might be touched by the user may be grounded. Japanese Unexamined Patent Appl. Pub. JP-A-H05-221085, for example, teaches a structure for passing static electricity discharged from the user's body to ground by connecting a switch that is touched by the user to the ground terminal of the frame.

Such conventional hardware solutions cannot completely prevent problems caused by static electricity, however, and an effective solution for when problems occur is not disclosed. The danger of problems due to static electricity thus remains with conventional interface devices, and great financial and other types of losses may be incurred until the interface device can be restored once such a problem occurs and the interface device stops functioning.

SUMMARY OF THE INVENTION

A printer according to the present invention that communicates with external devices through an interface device can take more effective measures against damage to the interface device caused by static electricity.

A first aspect of at least one embodiment of the invention is a printer that is connected to an interface device and communicates through the interface device with external devices, and has a detector that detects a prescribed operation of the printer, a controller that receives a query signal sent from the interface device, and confirms the reception status of the query signal after the detector detects the prescribed operation, and a controller that determines the operating status of the interface device based on the query signal reception status confirmed by the controller.

Preferably, the printer also has a recovery unit that turns the interface device power off, and after the power turns off, turns the power on again when the determination means determines that operation of the interface device has stopped.

Further preferably, the prescribed operation detected by the detector is the closing of a cover that opens the inside of the printer.

Yet further preferably, the query signal from the interface device is sent at a constant time interval, the reception status confirmed by the confirmation means is whether the query signal is received within a prescribed time, and the determination means determines that operation of the interface device stopped if the reception status confirmed by the confirmation means is no reception.

In a preferred aspect of at least one embodiment of the invention the interface device is disposed to the printer.

Another aspect of at least one embodiment of the invention is a printer that is connected to an interface device that sends a query signal at a prescribed time interval, and communicates with an external device through the interface device, wherein the printer turns the interface device power off, and after the power turns off, turns the power on again when the query signal sent from the interface device is not received for a prescribed time.

Another aspect of at least one embodiment of the invention is a control method for a printer that is connected to an interface device and communicates through the interface device with external devices, the control method having steps of: the printer detecting execution of a prescribed operation of the printer; the printer confirming the reception status of the query signal sent from the interface device after detecting the prescribed operation; and the printer determining the operating status of the interface device based on the confirmed query signal reception status.

Another aspect of at least one embodiment of the invention is a control program for a printer that is connected to an interface device and communicates through the interface device with external devices, the program having steps of: detecting execution of a prescribed operation of the printer; confirming the reception status of the query signal sent from the interface device after detecting the prescribed operation; and determining the operating status of the interface device based on the confirmed query signal reception status.

Other objects and attainments together with a fuller understanding of the invention will become apparent and appreciated by referring to the following description and claims taken in conjunction with the accompanying drawings.

DESCRIPTION OF PREFERRED EMBODIMENTS

Figure 1:
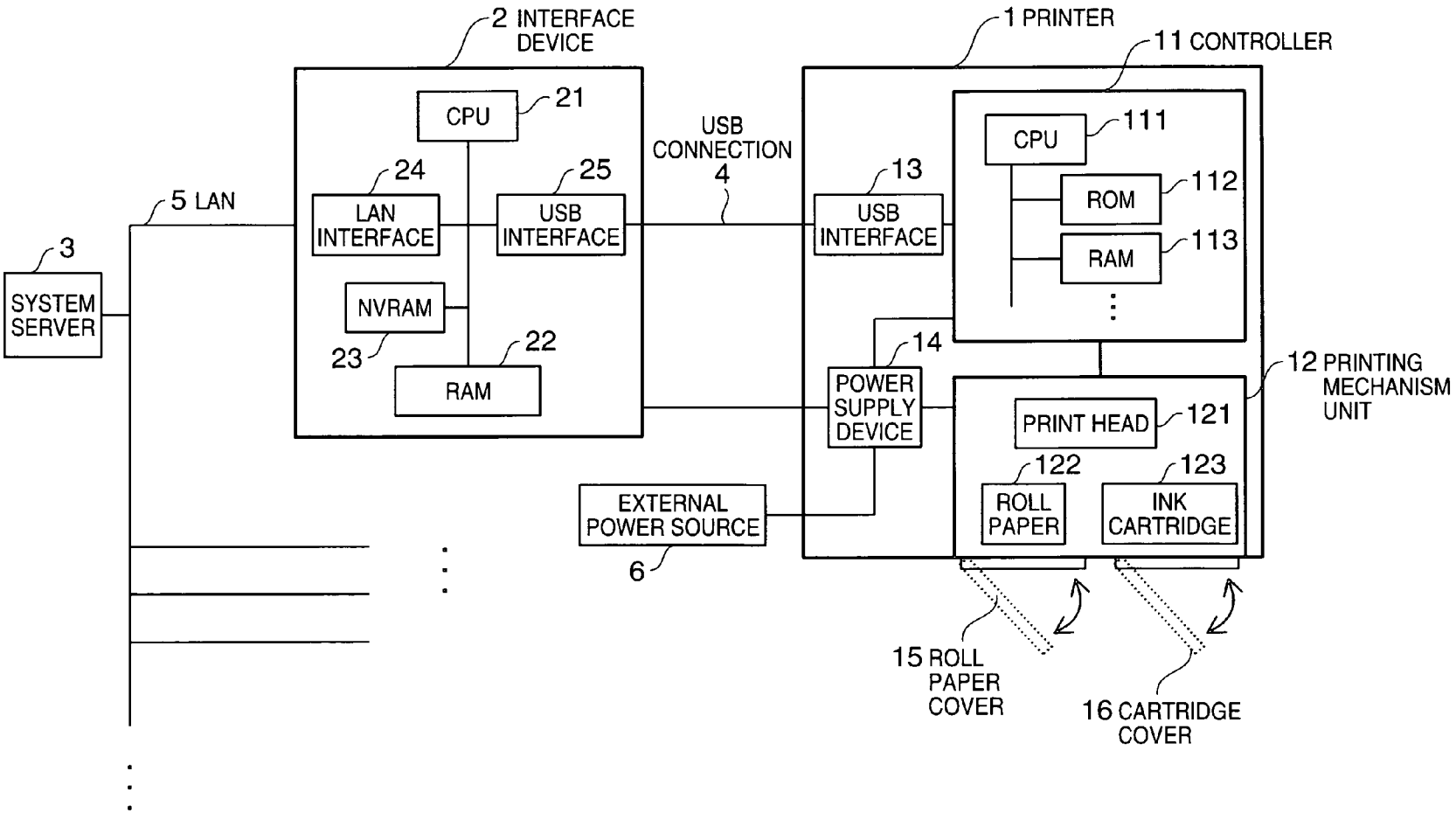
FIG. 1 is a block diagram of a preferred embodiment of a printer according to the invention.

A preferred embodiment of the present invention is described below with reference to the accompanying figures. The embodiment described below does not limit the technical scope of the invention. Note that identical or like parts are identified by the same reference numerals or symbols in the accompanying figures.

FIG. 1 is a block diagram showing a preferred embodiment of a printer according to the invention and a device to which the printer is connected. The printer 1 shown in FIG. 1 is a printer according to this embodiment of the invention, detects operations, such as closing the roll paper cover 15 or the cartridge cover 16 (see FIG. 2), which could result in an electrostatic discharge from the user's body, and determines the operating status of the interface device 2 based on the subsequent reception of query signals from the interface device 2. If the interface device 2 is determined to have stopped operating, the printer 1 turns the power to the interface device 2 off and then on to recover and attempts to execute an effective response to trouble with the interface device 2 caused by static electricity.

An example of a printer 1 according to this embodiment of the invention is a printer that is used for printing product discount coupons in a supermarket, for example, and is connected to a system server 3 from which print requests are received over a LAN 5 (local area network).

The system server 3 is a server that manages the issuance of discount coupons and is, for example, connected to a POS system (not shown in the figure) and outputs coupon printing commands to a plurality of printers 1 that are also connected to the LAN 5. The system server 3 can be used in a computer system.

An interface device 2 that controls the communication interface between the system server 3 and each printer 1 is disposed to each printer 1, and the printer 1 and the interface device 2 are connected according to the USB standard (USB connection 4), for example.

As shown in FIG. 1 the interface device 2 has a CPU 21, RAM 22, NVRAM 23, a LAN interface 24, and a USB interface 25, and provides the printer 1 with an interface function to the LAN 5 through the USB connection 4. For example, print commands and printer status queries issued from the system server 3 are received from the LAN 5 through the LAN interface 24 into RAM 22, and are passed from the USB interface 25 through the USB connection 4 to the printer 1. The interface device 2 also gets status information about the condition of the printer 1 from the printer 1 and stores the status information in RAM 22. More specifically, the interface device 2 sends a status query signal st to the printer 1 at a prescribed time interval (such as every 10 seconds), and stores the response received from the printer 1 in RAM 22.

The processes performed by the interface device 2 are executed by the CPU 21 operating according to a program and parameters that are stored primarily in NVRAM 23, for example. The programs and parameters stored in this NVRAM 23 can also be updated as needed by the system server 3.

Power for the interface device 2 is supplied from the printer 1 in this embodiment of the invention, but the interface device 2 could have its own power supply. The interface device 2 can be a device separate from the printer 1 or as a part of the printer 1.

The printer 1 in this example is an inkjet printer, and prints coupons using plural colors (such as CMY) in response to print requests from the system server 3. As shown in FIG. 1 the printer 1 has a controller 11, a printing mechanism unit 12, a USB interface 13, and a power supply device 14.

The controller 11 is the part that controls overall operation of the printer 1, and when printing, interprets the print data received from the system server 3, and generates the image data that is passed to the printing mechanism unit 12 and controls operation of the printing mechanism unit 12 based on the interpreted results. The controller 11 also executes the interface device 2 recovery process of this printer 1. The specific content of this recovery process is further described below.

As shown in FIG. 1 the controller 11 has a CPU 111, ROM 112, and RAM 113. The above-noted processes are executed primarily by the CPU 111 operating according to a program stored in the ROM 112. The image data to be printed, for example, is stored in the RAM 113.

Figure 2:
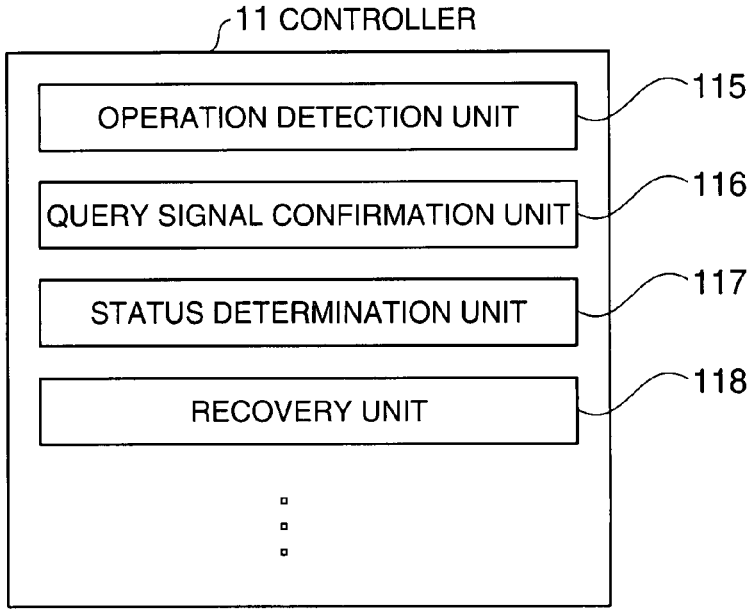
FIG. 2 is a function block diagram of the controller 11.

FIG. 2 is a function block diagram of the controller 11. Only the parts that are related to the recovery process of the interface device 2 are shown in FIG. 2. The operation detection unit 115, the query signal confirmation unit 116, the status determination unit 117, and the recovery unit 118 shown in the figure are performed by the CPU 111, the ROM 112, and the RAM 113. The functions of these different parts are described below.

The printing mechanism unit 12 is the part that executes the printing process as instructed by the controller 11 during printing. As shown in FIG. 1, because the printer 1 in this embodiment of the invention is an inkjet printer, the printing mechanism unit 12 has a print head 121 with a plurality of nozzles for discharging ink. This print head 121 is mounted on a carriage and discharges ink while moving in the main scanning direction over the paper recording medium in order to print. The paper in this printer 1 is roll paper 122 by way of example, and the ink discharged by the print head 121 is supplied from an ink cartridge 123.

Figure 3:
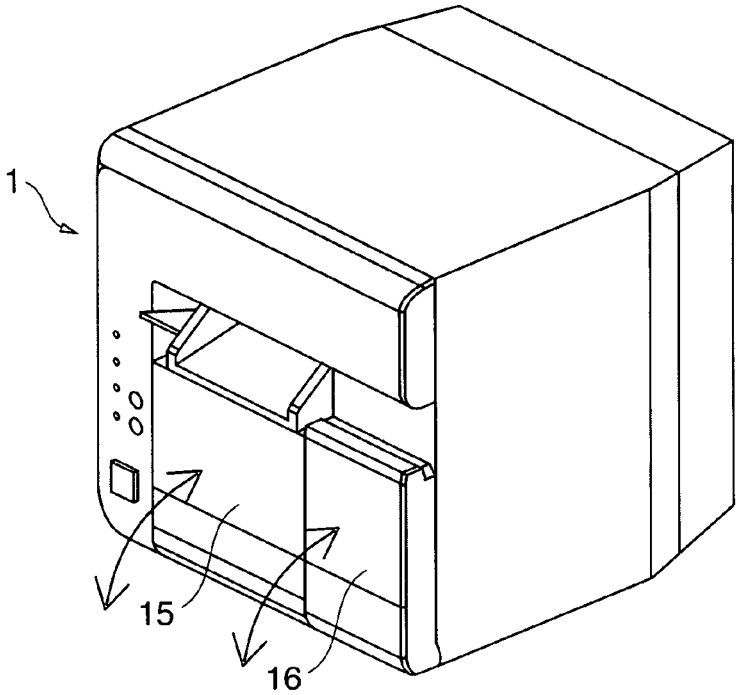
FIG. 3 is an oblique view of the printer 1.

The roll paper 122 and ink cartridge 123 are consumables that require appropriately replenishing or replacing by the user, and the printer 1 case therefore has a roll paper cover 15 and a cartridge cover 16 enabling replenishing or replacing the consumables (see FIG. 3). The covers 15 and 16 can be opened and closed by the user, and are opened when replenishing or replacing the consumables so that the user can access specific places inside the printer 1.

FIG. 3 is an oblique view of the printer 1. As shown in FIG. 3, the roll paper cover 15 and the cartridge cover 16 are disposed at the front of the printer 1, and can pivot as indicated by the arrows in the figure to open and close. FIG. 3 shows the covers 15 and 16 closed, but are opened to replace the consumables held inside so that the inside of the printer 1 is open.

The open or closed state of the roll paper cover 15 and the cartridge cover 16 is detected by a contact sensor (not shown in the figure) and reported to the controller 11.

The USB interface 13 shown in FIG. 1 is a communication interface connected to the interface device 2. The power supply device 14 regulates power supplied from the external power source 6 according to the power supply requirements of the printer 1, and supplies the power to the other parts of the printer 1 and to the interface device 2 as described above.

Figure 4:
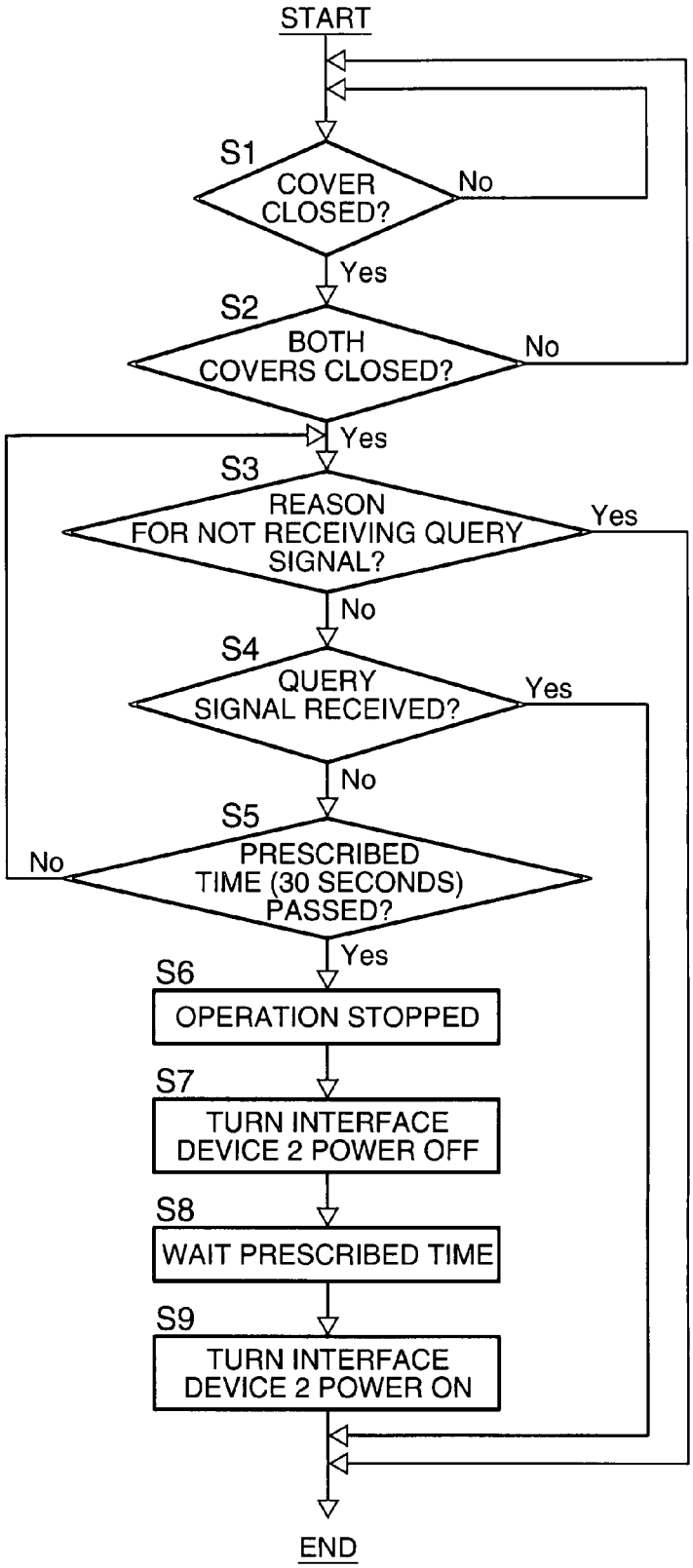
FIG. 4 is a flow chart describing the recovery process of the interface device 2.

The printer 1 thus arranged according to this embodiment of the invention is characterized by the interface device 2 recovery process described above, and the content of this recovery process is described next. FIG. 4 is a flow chart describing the steps of the recovery process executed by the controller 11 for the interface device 2.

The operation detection unit 115 of the controller 11 monitors opening and closing of the roll paper cover 15 and the cartridge cover 16. If the operation detection unit 115 detects that either cover is closed (step S1), it checks if the other cover is also closed (step S2). If the other cover is open (step S2 returns No), control returns to step S1 and monitoring cover opening and closing continues. If the other cover is also closed (step S2 returns Yes), both the roll paper cover 15 and the cartridge cover 16 are known to be closed, control goes to step S3 and receipt of a query signal from the interface device 2 is monitored.

If it is detected that both of the covers are closed, it is possible that the interface device 2 stopped operating as a result of the user touching inside the printer 1 and static being discharged. Triggered by detecting that the covers closed, the controller 11 therefore starts monitoring query signals from the interface device 2 in order to confirm the operating status of the interface device 2. Because whether both the roll paper cover 15 and the cartridge cover 16 are closed is confirmed, this monitoring state is actually entered when the roll paper cover 15 is closed if the cartridge cover 16 is already closed, and when the cartridge cover 16 is closed if the roll paper cover 15 is already closed.

Figure 5:
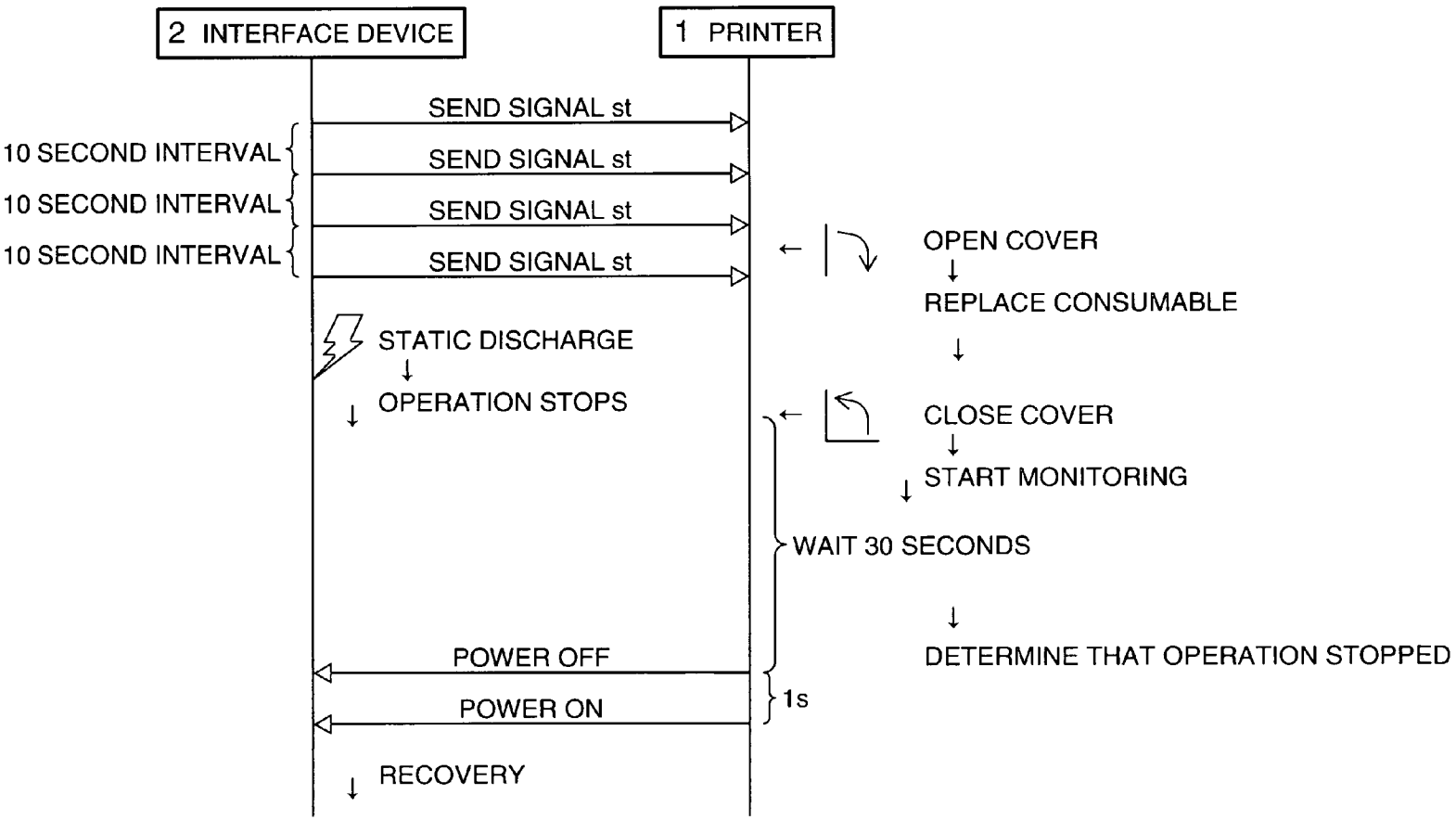
FIG. 5 is a sequence diagram of communication between the printer 1 and the interface device 2.

FIG. 5 describes communication between the printer 1 and the interface device 2 in this recovery process. As described above, the interface device 2 sends a status query signal st at a prescribed time interval (such as every 10 seconds), and the status query signal st is received by the query signal confirmation unit 116 of the printer 1. In the example shown in FIG. 5, when the roll paper cover 15 or the cartridge cover 16 of the printer 1 is then opened, the inside of the printer 1 is opened, and consumables (roll paper 122 or ink cartridge 123) are replaced by the user. In this example static is then discharged from the hand of the user to a metal part of the printer 1, and operation of the interface device 2 stops as indicated on the interface device 2 side in FIG. 5. After replacing the consumable, the user then closes the cover that was opened on the printer 1 side. The cover that was not used at this time is also closed, and the printer 1 starts looking for a query signal from the interface device 2. Control thus goes to step S3 in FIG. 4.

Returning to FIG. 4, when control goes to step S3 the query signal confirmation unit 116 of the controller 11 monitors reception of a query signal (signal st) from the interface device 2. The query signal confirmation unit 116 checks for a query signal from the interface device 2 for a preset prescribed time (such as 30 seconds). More specifically, whether a query signal is received from the interface device 2 within the prescribed time is monitored (steps S4 and S5).

During this time, the query signal confirmation unit 116 also checks for reasons why a query signal is not received (step S3). More specifically, the query signal confirmation unit 116 confirms if there is any clear reason why a query signal is not received from the interface device 2 other than that the interface device 2 has stopped operating due to a problem caused by static electricity. Reasons for not receiving a signal include, for example, that the program or parameters stored in the interface device 2 as described above are being updated by the system server 3, or that the USB connection 4 between the interface device 2 and the printer 1 was interrupted because the cable was disconnected. If the query signal confirmation unit 116 detects such a reason (step S3 returns Yes), query signal monitoring ends and the interface device 2 recovery process ends.

If a query signal from the interface device 2 is received within the prescribed time (step S4 returns Yes), the status determination unit 117 of the controller 11 determines that the interface device 2 has not stopped operating due to static electricity, and the interface device 2 recovery process ends.

If there is no reason why a signal cannot be received and a query signal from the interface device 2 is not received within the prescribed time (step S5 returns Yes), the status determination unit 117 of the controller 11 determines that the interface device 2 has stopped operating due to static electricity (step S6). The recovery unit 118 of the controller 11 then receives this decision from the status determination unit 117 and turns the power supply to the interface device 2 off (step S7). More specifically, the power supply from the power supply device 14 is stopped. The recovery unit 118 then waits a prescribed time (such as 1 second) to ensure that the power to the interface device 2 turns off (step S8), and then turns the interface device 2 power on again (step S9). Power supply from the power supply device 14 is thus resumed.

Thus turning the power off and on resets the interface device 2 and usually restores normal operation. More specifically, the interface device 2 is restored to the normal operating condition from the state in which communication was disabled by static electricity. The interface device 2 recovery process is thus executed.

In the example shown in FIG. 5 the interface device 2 is determined to have stopped operating because a status query signal st from the interface device 2 is not received by the printer 1 even after waiting 30 seconds (the prescribed time) after monitoring the query signal starts. The interface device 2 is then restored to the normal operating state by turning the interface device 2 power off, waiting one second, and then turning the power on again.

Closing the covers 15 and 16 is used as the trigger for starting to monitor the query signal in the embodiment described above, and the user opening and closing the covers 15 and 16 is thus used as the operation that could result in a problem due to static electricity, but other operations that could result in a problem due to static electricity can be used as the trigger to start monitoring query signals. Operations in which the user touches the back of the printer 1 could also be detected and used as the trigger, for example.

The invention is also not limited to detecting operations that could result in a problem due to static electricity, and reception of signals from the interface device 2 can be constantly monitored and the recovery process (turning the power off and on) can be executed if a signal is not received within a prescribed time.

Checking for reasons other than static electricity why signals are not received (step S3 in FIG. 4) can also be omitted.

The foregoing embodiment determines the operating status of the interface device 2 based on the presence of a query signal that is sent regularly from the interface device 2, but another operation of the interface device 2 that is executed during normal operation can be used instead.

As described above the printer 1 according to the preferred embodiment of the invention and variations thereof determines if the interface device 2 stopped operating due to static electricity by detecting the status of an operation that should occur when the interface device 2 is operating normally, such as whether a regularly output query signal is detected, when there is the possibility of trouble caused by static electricity, such as when the covers 15 and 16 are closed. Corrective action, that is, turning the interface device 2 power off and then on, can therefore be taken quickly when operation stops due to static electricity, and operation can be restored automatically at an early stage. Losses incurred by stoppage due to static electricity, including the recovery cost, can therefore be held low.

By using the operation of closing the covers 15 and 16 as the operation that could cause a problem due to static electricity, corrective action can be taken when the likelihood of trouble caused by static electricity is greatest, such as when static electricity can be easily discharged from the user when replacing consumables.

Furthermore, by using a query signal that is asserted repeatedly at a relatively short interval to determine the operating status of the interface device 2, the condition of the interface device 2 can be accurately determined at short intervals and quick recovery is possible when operation stops.

The scope of the present invention is not limited to the foregoing embodiments, and includes all aspects of the invention described in the accompanying claims and the equivalents.

What is claimed is:

1. A printer that is connected to an interface device that sends a query signal at a prescribed time interval, and communicates with an external device through the interface device, wherein:

the interface device sends a query signal to the printer;

the printer monitors the query signal to determine an operation of the interface device; and the printer turns power of the interface device off, and after the power turns off, turns the power on again when the query signal is not received for a prescribed time.

2. The printer described in claim 1, wherein the printer turns the interface device power off and after the power turns off, turns the power on again when the printer determines that the operation of the interface device has stopped.

3. The printer described in claim 1, wherein:

the printer monitors the query signal sent from the interface device after the printer detects a closing operation of a cover that opens the inside of the printer.

4. The printer described in claim 1, wherein:

the query signal from the interface device is sent at a constant time interval;

the reception status confirmed by the printer is whether the query signal is received within a prescribed time; and the printer determines that the operation of the interface device has stopped if the reception status confirmed by the controller is no reception.

5. The printer described in claim 1, wherein:

the interface device is disposed in the printer.

6. The printer described in claim 1, wherein:

the printer monitors the query signal sent from the interface device after the printer detects when a user touches the back of the printer.

7. A control method for a printer that is connected to an interface device and communicates through the interface device with external devices, comprising steps of:

the interface device sending a query signal to the printer;

the printer detecting execution of a prescribed operation of the printer;

the printer confirming a reception status of said query signal after detecting the prescribed operation; and the printer determining an operation of the interface device based on said reception status of said query signal.

8. The printer described in claim 7, wherein the printer turns the interface device power off and after the power turns off, turns the power on again when the printer determines that the operation of the interface device has stopped.

9. The printer described in claim 7, wherein:

the prescribed operation is a closing operation of a cover that opens the inside of the printer.

10. The printer described in claim 7, wherein:

the query signal from the interface device is sent at a constant time interval;

the reception status confirmed by the printer is whether the query signal is received within a prescribed time; and the printer determines that the operation of the interface device has stopped if the reception status confirmed by the controller is no reception.

11. The printer described in claim 7, wherein:

the interface device is disposed in the printer.

12. The printer described in claim 7, wherein:

the prescribed operation is when a user touches the back of the printer.

13. A printer that is connected to an interface device and communicates through the interface device with external devices, comprising:

a detector that detects a prescribed operation of the printer;

a controller that receives a query signal sent from the interface device to the printer, and confirms the reception status of the query signal after the detector detects the prescribed operation, and determines the operation of the interface device based on the query signal reception status confirmed by the controller.

14. The printer described in claim 13, wherein the controller turns the interface device power off and after the power turns off, turns the power on again when the controller determines that the operation of the interface device has stopped.

15. The printer described in claim 13, wherein:

the prescribed operation detected by the detector is a closing operation of a cover that opens the inside of the printer.

16. The printer described in claim 13, wherein:

the query signal from the interface device is sent at a constant time interval;

the reception status confirmed by the controller is whether the query signal is received within a prescribed time; and the controller determines that the operation of the interface device has stopped if the reception status confirmed by the controller is no reception.

17. The printer described in claim 13, wherein:

the prescribed operation detected by the detector is when a user touches the back of the printer.

18. A printer that is connected to an interface device and communicates with an external device through the interface device, wherein:

the interface device sends a query signal to the printer;

the printer monitors the query signal to determine an operation of the interface device;

the printer turns power of the interface device off and after the power turns off, turns the power on again when the operation of the interface device that is executed during a normal operation is not performed.

19. The printer described in claim 18, wherein the printer turns the interface device power off and after the power turns off, turns the power on again when the printer determines that the operation of the interface device has stopped.

20. The printer described in claim 18, wherein:

the prescribed operation is a closing operation of a cover that opens the inside of the printer.

21. The printer described in claim 18, wherein:

the query signal from the interface device is sent at a constant time interval;

the reception status confirmed by the printer is whether the query signal is received within a prescribed time; and the printer determines that the operation of the interface device has stopped if the reception status confirmed by the controller is no reception.

22. The printer described in claim 18, wherein:

the interface device is disposed in the printer.

23. The printer described in claim 18, wherein:

the prescribed operation is when a user touches the back of the printer.

* * * * *